United States Patent [19]

Qureshi

[11] 4,067,495

[45] Jan. 10, 1978

[54] UNITARY SPRING CLIP RAIL FASTENER

[75] Inventor: Khurshid Ahmed Qureshi, Bolingbrook, Ill.

[73] Assignee: Portec Inc., Railway Products Div., Oak Brook, Ill.

[21] Appl. No.: 608,792

[22] Filed: Aug. 28, 1975

[51] Int. Cl.[2] ..... E01B 9/30; E01B 29/24

[52] U.S. Cl. ..... 238/349; 238/352

[58] Field of Search ..... 238/323, 349, 351, 352, 238/310

[56] References Cited

U.S. PATENT DOCUMENTS

| | | | |
|---|---|---|---|
| 2,780,416 | 2/1957 | Hodel | 238/349 |
| 3,338,521 | 8/1967 | Sanson | 238/349 |
| 3,519,205 | 7/1970 | Monclin et al. | 238/351 X |
| 3,690,551 | 9/1972 | Munch | 238/349 |
| 3,696,998 | 10/1972 | Nair | 238/349 |
| 3,876,141 | 4/1975 | French | 238/349 |

FOREIGN PATENT DOCUMENTS

| | | | |
|---|---|---|---|
| 1,020,046 | 11/1957 | Germany | 238/349 |
| 1,132,943 | 7/1962 | Germany | 238/349 |
| 46,207 | 10/1962 | Poland | 238/349 |
| 1,044,884 | 10/1966 | United Kingdom | 238/349 |

*Primary Examiner*—Robert J. Spar
*Assistant Examiner*—Carl Rowold
*Attorney, Agent, or Firm*—Emory L. Groff, Jr.

[57] ABSTRACT

A rail fastener includes an anchor member fixed atop the crosstie and removably retaining a spring clip having a pair of adjacent parallel legs insertable within said anchor member. The improved spring clip, generally "B" shaped, is provided with a loop member joining the two legs and having opposite portions respectively engaging the rail base flange and anchor member.

18 Claims, 12 Drawing Figures

UNITARY SPRING CLIP RAIL FASTENER

This invention relates generally to railway appliances, and more particularly, to an improved rail fastener for securing railway rails to crossties constructed either of concrete, plastic, metal or wood.

The present rail fastener includes an elastic metal clip formed from steel rod or bar stock to provide a unitary member adapted to cooperate with an anchor or shoulder member fixably installed adjacent the rail base flange to removably secure the rail clip in a position retaining a portion of the clip in an overlying and biasing manner upon the upper surface of one of the rail base flanges. By this arrangement the spring clip and anchor member combine to reduce longitudinal creeping of the rail as well as inhibit pumping of the crosstie into the ballast as normally caused by wave motion of the rail due to passage of traffic thereover. Additionally, tendency of the rail to overturn is resisted to a greater degree than with many earlier types of clips.

Many attempts have been made to produce spring clips intended to accomplish the above related objectives. Examples of earlier efforts in this area are found in U.S. Pat. No. 3,004,716 issued Oct. 17, 1961 and U.S. Pat. No. 3,297,253 issued Jan. 10, 1967. In the examples of the referenced prior art, spring clips are disclosed having an irregular configuration from one end of the rod stock to the other end thereof, such that a plurality of compound curves must be formed in order to produce the spring clip and the resultant clip may only be applied in one direction adjacent each rail base flange. By the present arrangement, on the other hand, an improved spring clip is produced which is symmetrical about both sides of a center line passing between its two parallel mounting legs, and although a curved loop member is included in the instant spring clip, this loop member defines a simple curve rather than a complex compound curve as found in many of the prior art devices of this type. A significant advantage of the present arrangement will be obvious when considering the relative ease of manufacture thereof and also the more positive control of the resultant clamping or biasing action that is afforded by the instant device in view of its vastly simpler symmetrical construction. The increased downward clamping force as produced by the instant clip having two mounting legs offers a decidedly significant improvement over the previously used fasteners having but a single leg.

Accordingly, one of the primary objects of the present invention is to provide an improved rail fastener including a spring clip of symmetrical construction and substantially defining a "B" shaped configuration.

Another object of the present invention is to provide an improved rail fastener including a spring clip formed from a unitary bar or rod stock and including a pair of adjacent parallel mounting legs having distal portions projecting in the same direction and substantially confined within an encircling loop member joined to the ends of the mounting legs.

Still another object of the present invention is to provide an improved rail fastener including a spring clip of unitary bar or rod construction having a pair of parallel and adjacent mounting legs removably insertable within one or more transverse openings provided in an anchor member affixed to a crosstie adjacent a rail base flange.

With these and other objects in view which will more readily appear as the nature of the invention is better understood, the invention consists in the novel construction, combination and arrangement of parts hereinafter more fully described, illustrated and claimed.

Preferred and practical embodiments of the invention are shown in the accompanying drawings, in which.

Similar reference characters designate corresponding parts throughout the several views of the drawings.

Figure 1:
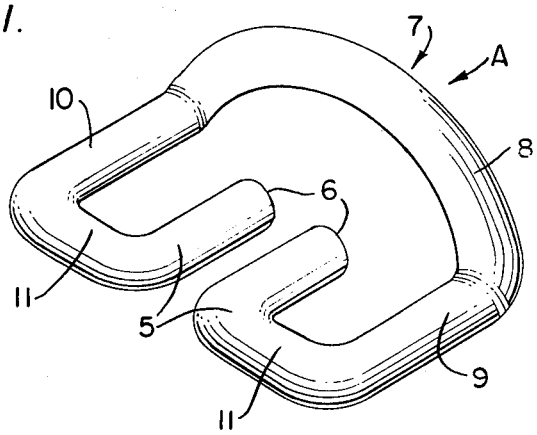
FIG. 1 is a perspective view of a spring clip according to the present invention.
Figure 2:
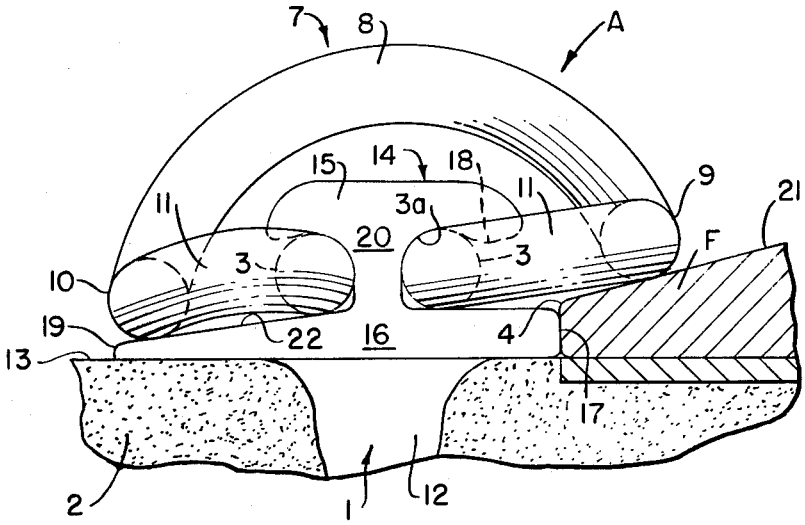
FIG. 2 is a side elevation, partly in section, of the rail fastener of the present invention as applied to a concrete crosstie.
Figure 3:
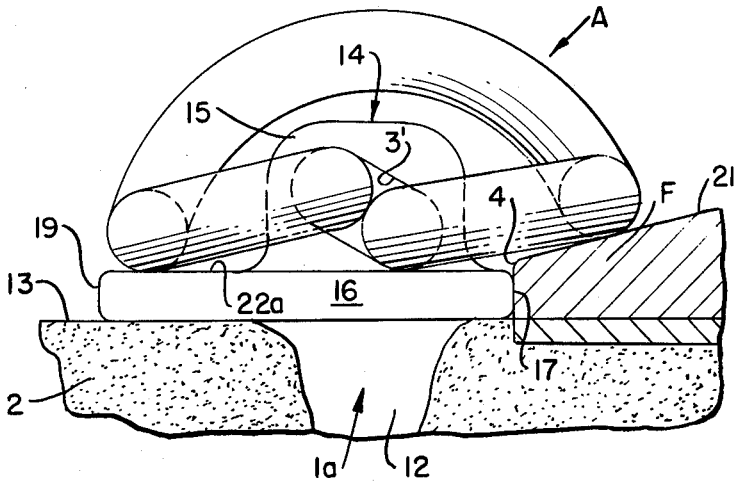
FIG. 3 is a view similar to FIG. 2 and illustrates an anchor member of alternative construction.

Referring now to the drawings, particularly FIGS. 1–3, the present invention will be seen to include a spring clip A which is adapted to be removably secured in its use position by means of an anchor member 1 suitably fixed to a crosstie 2 and including one or more attachment grooves or openings 4 disposed adjacent the edge 4 of a rail base flange F. The spring clip A as shown most clearly in FIG. 1 compriss an elastic device formed from a single piece of metal and preferably is produced from steel rod or bar stock.

The spring clip A as shown in the embodiment of FIGS. 1–4 is produced from rod stock and includes a pair of adjacent and parallel straight mounting legs 5—5 terminating in distal portions 6—6 projecting in the same direction. The balance of the spring clip A comprises a loop member 7 which will be seen to surround or encompass the described mounting legs 5—5 and includes a curved cross-over arm 8 joined at its opposite ends by an inside rail bearing portion 9 and outside tie anchor portion 10 respectively, which latter two portions are in turn connected to the mounting legs 5 by means of end connecting portions 11—11. The above described arrangement of the various portions of the spring clip A approximately defines a "B" shaped configuration and except for the cross-over arm 8, is made up of a plurality of straight sections, each disposed normal to the next adjacent section. The cross-over arm 8, on the other hand, comprises an arched element formed with a simple curve for reasons which will become obvious hereinafter.

An important feature to be noted regarding the subject spring clip A is that the construction thereof defines a symmetrical configuration along either side of an axis passing parallel to and between the two mounting legs 5—5. Such an arrangement facilitates the manufacture of the spring clip A by removing the requirement for more specialized dies and forming apparatus and subsequently facilitates the use of the spring clip as will be described later on.

Figure 4:
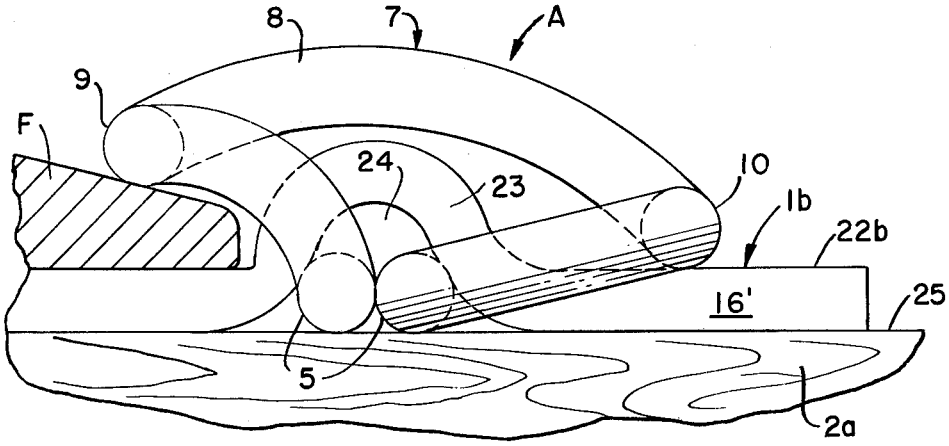
FIG. 4 is an end elevation, partly in section, of a rail fastener according to the present invention as applied to a wood crosstie.

The anchor means for retaining the spring clip A in its use position of FIGS. 2-4 may comprise any one of several types of elements. In the case of a plastic or concrete crosstie 2 as shown in FIGS. 2 and 3, it is possible to provide a cast anchor member 1 or 1*a* which may be imbedded within the composition of the crosstie at the time of its manufacture. 1 and 1*a* reflect alternate forms of tie anchor members suitable for use with plastic or concrete crossties, and each includes a shank 12 adapted to be fully imbedded within the composition of the crosstie and which supports, in a fixed manner, adjacent the upper surface 13 of the crosstie, a head generally designated 14. Each head includes a cap 15 disposed in an elevated manner above a larger platform 16, which platform includes an inner surface 17 selected to establish the track gauge upon the subsequent placement of a rail flange edge 4 adjacent thereto. Projecting outwardly from the cap 15, the platform 16 terminates in an outer surface 19.

As previously mentioned, the anchor member heads 14 are provided with one or more transverse attachment means in the form of a groove or opening 3 for removably retaining the spring clip A in its use position and the anchor tie member 1 of FIG. 2 will be seen to include a pair of transverse grooves 3—3 separated by means of a web 20. A feature to be noted at this point is that the inner periphery of the web 20 and cap 15 in the upper area of the seat of the groove 3 is provided with a curved bearing surface 3*a* congruent with the curved circumference of the rod stock forming the mounting legs 5—5 of the spring clip A, thereby providing a mating fit and positive retention means encompassing approximately 90° of the circumference of the clip mounting legs when they have been axially inserted into the grooves 3—3 by any suitable means such as a maul. Additionally, the terminal portions 18 of the cap 15 defining the grooves 3—3 extend downwardly to restrict the outer portions of the grooves to a height less than the diameter of the clip stock in order to ensure retention of the clip legs 5 in a fully seated position against the bearing surface 3*a*.

When the spring clip is fully seated as in FIG. 2 of the drawings it will be understood that the inside rail bearing portion 9 will be deflected upwardly against a tremendous resilient force as transmitted by the cross-over arm 8 with the result that a significant downward biasing action will be offered by the entire length of the undersurface of the rail bearing portion 9 against the top surface 21 of the rail base flange F, while the top surface 22 of the outer portion of the platform 16 serves as an abutment for the outside tie anchor portion 10 of the spring clip to limit downward displacement of the outside portion 10 when both of the mounting legs 5—5 are seated within the tie anchor member attachment grooves 3—3.

The modified anchor member 1*a* illustrated in FIG. 3 of the drawings includes a single elongated transverse opening 3' in the cap 15 thereof, which opening 3' is oval in configuration and includes a major axis equal to no less than twice the diameter of one of the mounting legs 5 and a minor axis equal to no less than the diameter of one of the mounting legs 5, such that when the two legs are simultaneously urged into the attachment opening 3' as shown in FIG. 3, there will be no free play. Since use of the anchor member 1*a* means that the two mounting legs 5—5 will be drawn together and the outside-most mounting leg will be elevated above the longitudinal axis of the inside mounting leg 5, it will follow that the outside tie anchor portion 10 of the spring clip A needs to be retained at a more elevated position than that as shown in the embodiment of FIG. 2 in order to obtain the same maximum force or biasing action between the undersurface of the inside rail bearing portion 9 and the top surface 21 of the rail base flange F, and accordingly, it will be observed that the top surface 22*a* of the platform 16 in the embodiment of FIG. 3 is disposed at the same elevation as the bottom-most portion of the transverse opening 3'.

When utilizing the spring clips of the present invention in combination with a wood crosstie 2*a* as shown in FIG. 4 of the drawings, the anchor means for securing and retaining the clip in its use position may most readily be provided by means of a base plate 1*b* comprising a steel plate completely underlying the rail base flanges F and extending significantly beyond the two edges 4—4 of the rail base to provide the platform portions 16'. The base plate 1*b* is provided with a rib 23 immediately adjacent each rail base flange edge 4 and intermediate this edge and the base plate platform 16'. The rib 23 comprises an upwardly curved deformation in the base plate, resulting in the transverse attachment groove or opening 24 being formed beneath its undersurface and the upper surface 25 of the crosstie. It will thus follow that this attachment means 24 performs in a manner similar to the grooves 3—3 of the anchor member 1 and the opening 3' of the anchor member 1*a* and is adapted to receive the two mounting legs 5—5 of the spring clip A in the juxtaposed manner illustrated in FIG. 4. Quite obviously the dimensions of the rod stock forming the spring clip A is preferably selected to ensure the point contact as shown in this figure of the drawings, thus ensuring a rigid securing of the clip legs when axially inserted into the opening 24.

Figure 5:
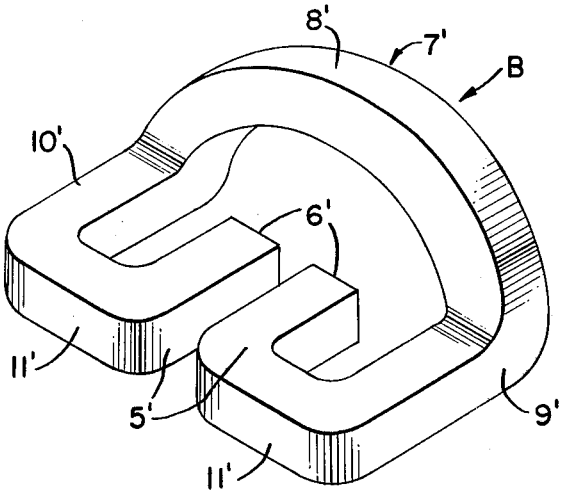
FIG. 5 is a perspective view of a modification of the spring clip of the present invention.

FIG. 5 of the drawings illustrates a modified spring clip B having a general configuration similar to that of the spring clip A with the exception that this latter spring clip is formed from rectangular or square bar stock instead of the cylindrical rod stock of the spring clip A. Accordingly, it will be appreciated that the clip B contains the same described features as the clip A, including the pair of adjacent parallel mounting legs 5'—5' having the distal portions 6' projecting in the same direction and enclosed by the loop member 7' which in turn comprises the curved cross-over arm 8', parallel inside rail bearing portion 9' and outside tie anchor portion 10', which in turn are respectively connected to the two mounting legs by means of the end connecting portions 11'. As in the case of the earlier described spring clip A, the mounting legs and connecting portions and inside and outside portions of the spring clip B are normally disposed in a common horizontal plane when in the at rest position of FIG. 5 prior to application to a suitable anchor member in a track installation and likewise the simple curved configuration of the cross-over arm 8' extends upwardly and perpendicular to the balance of the spring clip.

Figure 6:
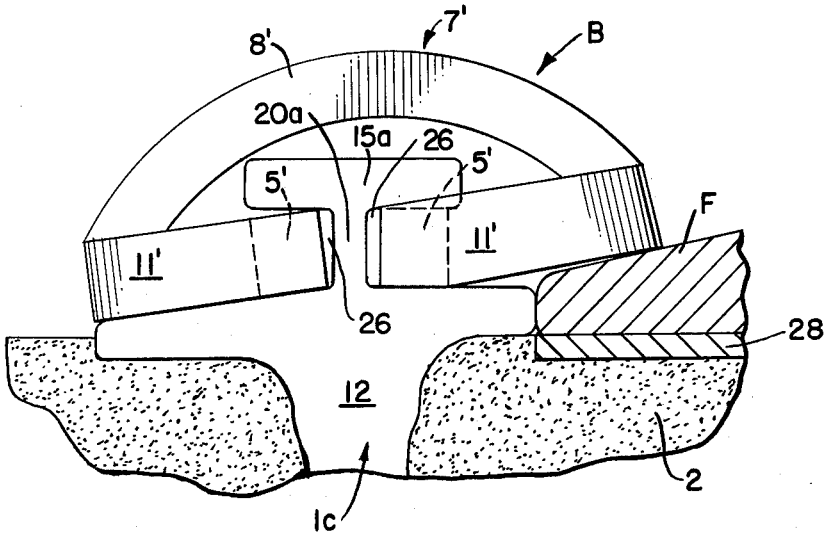
FIG. 6 is a side view, partly in section, and illustrates the spring clip of FIG. 5 as installed with an anchor member imbedded in a concrete crosstie.
Figure 7:
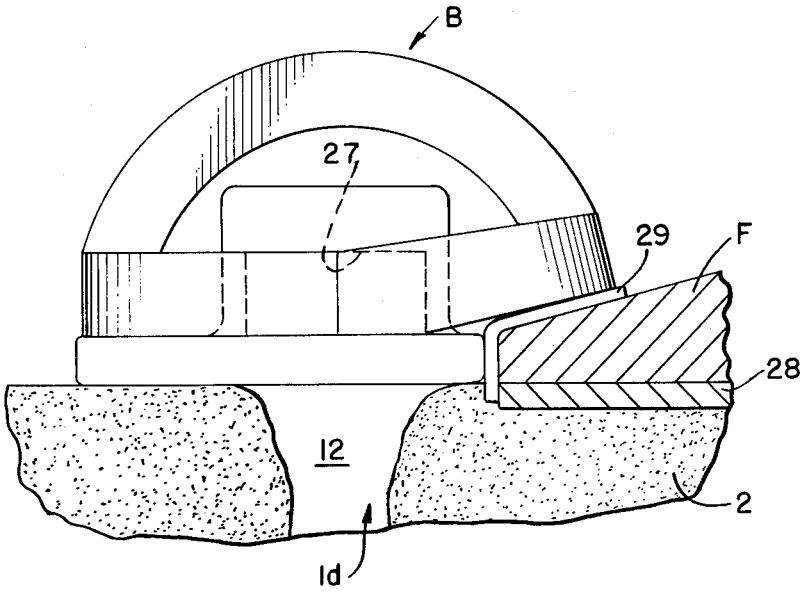
FIG. 7 is a view similar to FIG. 6 and illustrates a modified form of anchor member.

The spring clip B, like the spring clip A, may be utilized in combination with either a concrete or plastic crosstie as well as with a wooden crosstie. In the case of a wood tie 2*a* the clip B is installed using the same type of base plate 1*b* as shown in the embodiment of FIG. 4 of the drawings, while when installed in combination with a plastic or concrete tie the cast anchor member 1*c* of FIG. 6 or 1*d* of FIG. 7 is employed. The tie anchor member 1*c* is substantially similar to the anchor member 1 of FIG. 2 with the exception that the cap 15*a* and central web 20*a* are formed with straight walled portions to provide the attachment grooves or opening 26—26 having a polygonal cross-section providing a close mating fit with the rectangular cross-section of the bar stock forming the spring clip B. Similarly, in the embodiment of FIG. 7 of the drawings the transverse opening 27 of the anchor member 1*d* is formed with a rectangular configuration to accept the two mounting legs 5'—5' of the spring clip B with a close mating fit.

As is well known in the rail fastener art, an insulated installation may be provided by including a suitable tie pad 28 between the undersurface of the rail base and the upper surface of the crosstie and this tie pad may be combined with an appropriate insulated clip 29 disposed between the spring clip portion 9 and the upper surface 21 of the rail base flange and extending downwardly to separate the rail edge 4 from the anchor member as shown in FIG. 7 of the drawings.

Figure 8:
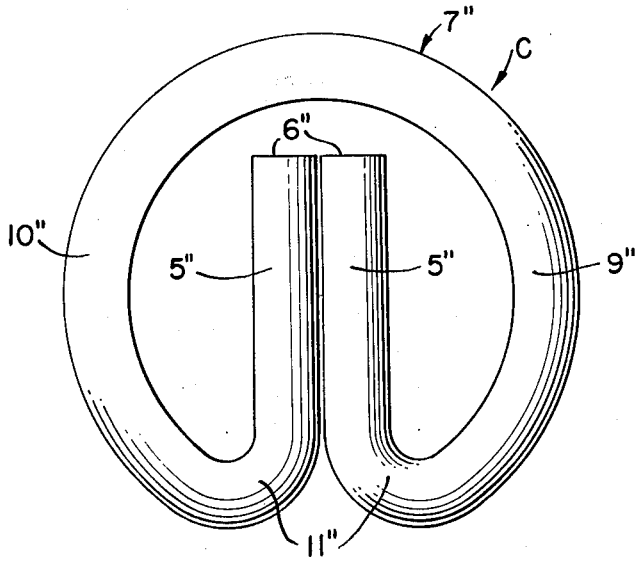
FIG. 8 is a top plan view of a modification of the spring clip of the present invention.
Figure 9:
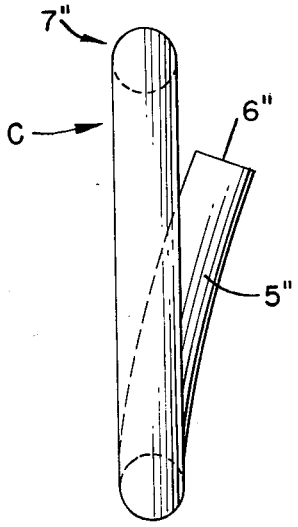
FIG. 9 is an end elevation of the spring clip of FIG. 8.

The spring clip C disclosed in FIGS. 8 and 9 of the drawings comprises a further modification and is preferably constructed of rod stock and will be seen to include the same arrangement of a pair of adjacent and parallel mounting legs 5"—5", each having distal portions 6" projecting in the same direction and which are connected by the loop member 7" comprising in turn the inside rail bearing portion 9" and outside tie anchor engaging portion 10" which latter portions are joined to the mounting legs by means of the end connecting portions 11". The loop member 7" will be noted to include a cross-over arm portion as do the other described embodiments and although not specifically identified in FIG. 8, it will be understood this cross-over arm comprises the central-most portion of the loop member 7" in the area adjacent the leg ends 6"—6" and, like the remaining embodiments, extends in a direction perpendicular to the running length of the rail base flange. In this arrangement the entire loop member 7" is preferably disposed in a single plane when in the at rest consition with the two mounting legs 5" disposed in a curved and slightly offset manner as shown most clearly in FIG. 9 of the drawings, which configuration facilitates the initial entry of the distal leg portions 6" into the attachment grooves or openings of the selected anchor member. It will be appreciated that either of the shoulder or anchor members 1, 1*a* or 1*b* may be used in combination with the spring clip C to provide a rail fastener installation.

Figure 10:
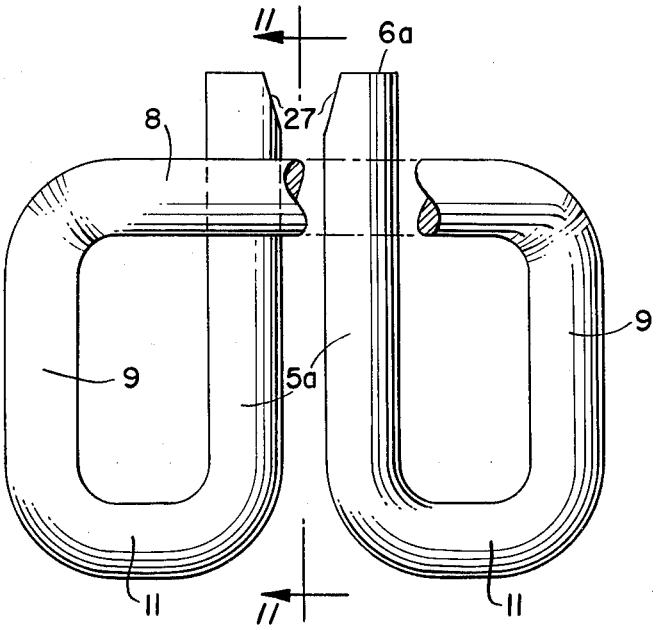
FIG. 10 is a top plan view of another form of spring clip of the present invention.
Figure 11:
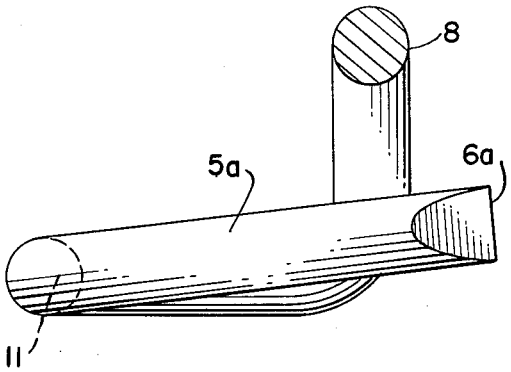
FIG. 11 is a vertical sectional view taken along the line 11—11 of FIG. 10.

The spring clip D illustrated in FIGS. 10 and 11 may likewise be utilized with either the tie plate form of anchor member or one of the disclosed cast-in-tie forms of shoulder or anchor members and is constructed in a manner generally similar to the clips A & B. The mounting legs 52—52 are preferably slightly inclined upwardly from the end connecting portions 11 and the distal portions 6 thereof extend substantially beyond the vertical plane of the cross-over arm 8. To facilitate insertion of the legs 52 into the openings 26*a* on either side of the central web 20*b* of the shoulder or anchor member 1*e*, each distal portion 6*a* is provided with a chamfer 27 as shown in FIG. 10.

Figure 12:
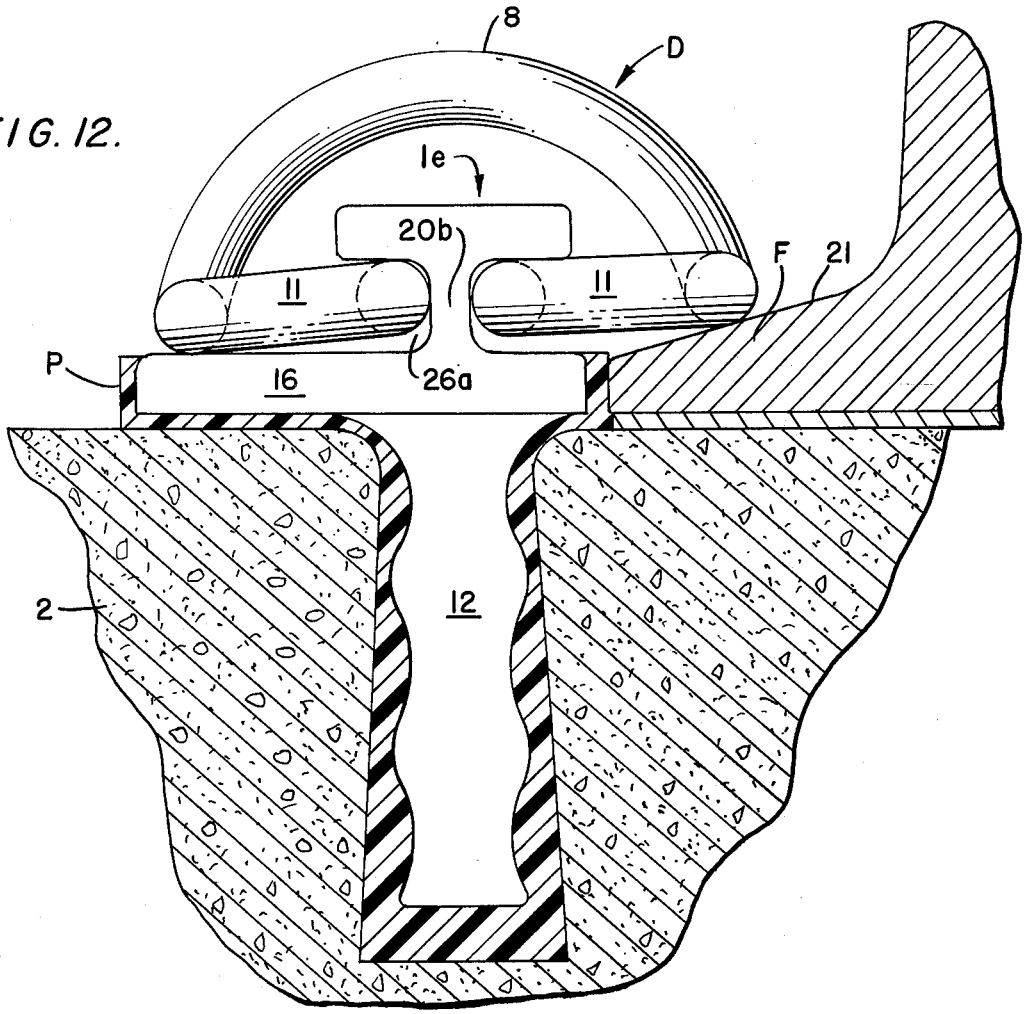
FIG. 12 is a side elevation, partly in section, similar to the arrangement shown in FIG. 2, but with the anchor member coated with insulation.

To insure a fully insulated rail fastener assembly any one of the embedded shoulder or anchor members may be coated or covered with any suitable insulating material such as ceramic, epoxy or urethane prior to casting within the crosstie. Such an arrangement is shown in FIG. 12 wherein it will be seen that the shank 12 and platform 16 of the member 1*e* are thusly encapsulated, as at P.

I claim:

1. A fastener for securing a rail base flange to a crosstie including, anchor means secured atop said crosstie and having attachment means disposed adjacent said rail base flange, a spring clip of unitary metallic stock having a pair of adjacent and parallel mounting legs terminating in distal free end portions projecting in the same direction and engaging with said attachment means on said anchor means, said engaged mounting legs disposed parallel to the running length of said rail base flange, a single loop member joining said clip legs and including oppositely disposed rail bearing and tie anchor portions engaging said rail base flange and anchor means, respectively, said loop member including a curved cross-over arm extending in a direction perpendicular to the running length of said rail base flange and connected at opposite ends to said rail bearing and tie anchor portions respectively, an end connecting portion in turn joining each said rail bearing and tie anchor portions respectively to said mounting legs, and said curved cross-over arm extends vertically above the plane of all remaining structure of said clip both when applied to said anchor means and when removed therefrom.

2. A rail fastener according to claim 1 wherein, said spring clip defines a B-shaped configuration in top plan.

3. A rail fastener according to claim 1 wherein, said spring clip stock is cylindrical in cross-section.

4. A rail fastener according to claim 1 wherein, said spring clip stock is polygonal in cross-section.

5. A rail fastener according to claim 1 wherein, said spring clip stock is rectangular in cross-section.

6. A rail fastener according to claim 1 wherein, said spring clip is symmetrical about an axis passing between said mounting legs.

7. A rail fastener according to claim 1 wherein, said attachment means includes a pair of grooves in said anchor means.

8. A rail fastener according to claim 1 wherein, said attachment means includes a single opening in said anchor means within which both said mounting legs are disposed.

9. A rail fastener according to claim 1 wherein, said loop member cross-over arm includes a single curved element disposed in a single vertical plane and encompassing therebeneath said mounting legs.

10. A rail fastener according to claim 1 wherein, said rail bearing and tie anchor portions are parallel to said mounting legs and normal to said end connecting portions and said cross-over arm.

11. A rail fastener according to claim 1 wherein, said rail bearing, tie anchor and end connecting portions and said mounting legs are disposed in a common plane when said spring clip is removed from said anchor means.

12. A rail fastener according to claim 1 wherein, said rail bearing, tie anchor and end connecting portions are disposed in a common plane when said spring clip is removed from said anchor means and said parallel mounting legs are vertically inclined away from said end connecting portions to said distal portions.

13. A rail fastener according to claim 7 wherein, said anchor means includes an anchor member having a shank disposed within said crosstie, a head connected to said shank and provided with a platform atop said crosstie, and said grooves are disposed in said head above said platform.

14. A rail fastener according to claim 8 wherein, said anchor means includes an anchor member having a shank disposed within said crosstie, a head connected to said shank and provided with a platform atop said crosstie, and said opening is disposed through said head above said platform.

15. A rail fastener according to claim 8 wherein, said anchor means includes a base plate underlying said rail base flange and extending beyond the edge thereof to provide a platform atop said crosstie, and said platform includes a raised rib defining said opening therebeneath.

16. A rail fastener according to claim 9 wherein, said mounting leg distal portions extend beyond the vertical plane of said loop member curved element.

17. A rail fastener according to claim 9 wherein, said leg distal portions includes opposed chamfers.

18. A rail fastener according to claim 13 including, an insulating composition surrounding said shank and said platform.

* * * * *